US007924262B2

(12) United States Patent
Chae

(10) Patent No.: US 7,924,262 B2
(45) Date of Patent: Apr. 12, 2011

(54) LIGHT SOURCE DRIVING APPARATUS, DISPLAY DEVICE HAVING THE SAME AND METHOD OF DRIVING A LIGHT SOURCE

(75) Inventor: Jong-Seok Chae, Seoul (KR)

(73) Assignee: Samsung Electronics Co., Ltd. (KR)

( * ) Notice: Subject to any disclaimer, the term of this patent is extended or adjusted under 35 U.S.C. 154(b) by 630 days.

(21) Appl. No.: 11/561,630

(22) Filed: Nov. 20, 2006

(65) Prior Publication Data

US 2007/0126690 A1 Jun. 7, 2007

(30) Foreign Application Priority Data

Dec. 6, 2005 (KR) ..... 10-2005-0117891

(51) Int. Cl.
*G09G 3/36* (2006.01)

(52) U.S. Cl. ..... 345/102; 345/87

(58) Field of Classification Search ..... 345/87–104
See application file for complete search history.

(56) References Cited

U.S. PATENT DOCUMENTS 7,034,800 B2 * 4/2006 Nakatsuka et al. ..... 345/102
7,365,730 B2 * 4/2008 Suzuki ..... 345/102
2005/0116921 A1 * 6/2005 Kim ..... 345/102
2005/0231457 A1 * 10/2005 Yamamoto et al. ..... 345/102
2006/0007112 A1 * 1/2006 Park ..... 345/102
2010/0134406 A1 * 6/2010 Maruyama et al. ..... 345/102

* cited by examiner

*Primary Examiner* — Amare Mengistu
*Assistant Examiner* — Dmitriy Bolotin
(74) *Attorney, Agent, or Firm* — Cantor Colburn LLP

(57) ABSTRACT

A light source driving apparatus according to the present invention includes a controller, a first driver and a second driver. The controller outputs a first control signal to drive the light source in a normal-luminance mode and outputs a second control signal to drive the light source in a low-luminance mode. The first driver drives the light source, based on a first voltage in response to the first control signal in the low-luminance mode. The second driver drives the light source, based on a second voltage in response to the second control signal in the normal luminance mode. Therefore, the light source driving apparatus driving the light source decreases current-consumption and prevents unnecessary power consumption from increasing in a low-luminance driving mode.

14 Claims, 5 Drawing Sheets

LIGHT SOURCE DRIVING APPARATUS, DISPLAY DEVICE HAVING THE SAME AND METHOD OF DRIVING A LIGHT SOURCE

This application claims priority to Korean Patent Application No. 2005-117891, filed on Dec. 6, 2005, and all the benefits accruing therefrom under 35 U.S.C. §119, the contents of which in its entirety are herein incorporated by reference.

BACKGROUND OF THE INVENTION

1. Field of the Invention

The present invention relates to a light source driving apparatus for driving a light source, a display device having the light source driving apparatus and a method of driving a light source. More particularly, the present invention relates to a light source driving apparatus, which is capable of decreasing power consumption, a display device having the light source driving apparatus and a method of driving a light source.

2. Description of the Related Art

Recently, due to rapid development of data processing devices, a display device displaying images corresponding to processed data by a data-processing device has also been recently developed. Flat panel type display devices, in particular, have been developed because of their small size, light weight, full-color and realization of high resolution images compared to a cathode-ray tube ("CRT") type display device.

Flat panel type display devices include a liquid crystal display ("LCD") apparatus, a plasma display panel ("PDP"), an electro luminescence (EL) apparatus, etc. The LCD apparatus employed by a mobile phone, a computer monitor and a notebook computer, etc.

The LCD apparatus includes a display unit. The display unit includes an LCD panel and a driving module. The LCD panel has a screen and displays an image. The driving module provides a driving signal to the LCD panel.

The LCD panel includes a first substrate and a second substrate. The first substrate includes a thin film transistor array. The second substrate is combined with the first substrate such that a liquid crystal layer is disposed between the first and second substrates. When the driving signal is applied to electrodes formed at the first and second substrates, respectively, a respective thin film transistor of the thin film transistor array is turned on to generate an electric field between the first substrate and the second substrate. As a result, an arrangement of liquid crystal molecules of the liquid crystal layer is changed in response to the electric field applied thereto, and thus a light transmittance of the liquid crystal layer is changed to display an image.

Therefore, the LCD apparatus requires a light source unit that provides a light with a predetermined luminance to display images.

The light source unit includes a light source and optical members. The light source generates light with a predetermined luminance. The optical members improve optical characteristics of the light generated by the light source and provides the LCD panel with the light having improved characteristics.

Generally, a cold cathode fluorescent lamp ("CCFL") may be employed as the light source. Also, a light-emitting diode may be employed as the light source.

For example, the light-emitting diode may include a plurality of light-emitting diodes emitting a red-colored light, a green-colored light and a blue-colored light, respectively, that are employed in an LCD apparatus. The LCD apparatus includes a light source driving unit driving the light-emitting diode to provide a synthesized-white light to the LCD panel by controlling luminance of the red-colored light, the green-colored light and the blue-colored light emitted from the light-emitting diodes.

Generally, when the LCD apparatus, for example, is employed in a mobile device such as a mobile phone, the light source driving unit drives the light source in a first driving mode, a second driving mode and a third driving mode.

The first driving mode may be defined as a normal-luminance driving mode. In order for the LCD apparatus employed in a mobile device to display an image at an initial driving, the light source driving unit provides a high voltage to the light-emitting diode to display an image with a normal luminance.

The second driving mode may be defined as a low-luminance driving mode, which is called a dimming mode. After the LCD apparatus is driven in the first driving mode, the light source driving unit provides a low voltage, which is lower than a voltage provided in the first driving mode. The light source driving unit provides the low voltage to the light-emitting diode according to an external signal or a sensing-signal outputted by sensing an external luminance, so that the LCD apparatus displays an image of a low luminance.

Therefore, when the LCD apparatus is driven in the second driving mode, an electric power consumed by the light source unit is reduced. As a result, power consumption of the LCD apparatus is decreased.

The third driving mode may be defined as a standby mode in which the light-emitting diode is turned off. After the LCD apparatus is driven in the second driving mode during a predetermined time, the light emitting diode is turned off in the third driving mode.

As mentioned above, according to the light source driving unit that is driven in the first to third driving modes, power consumption of the LCD apparatus is decreased compared to driving only in the first mode or first and third modes. When the LCD apparatus is applied to the mobile device using a battery with a limited electric power as a power supply device, the time of using the mobile device is increased by employing a light source driving unit that is driven in the first to third driving modes.

Generally, the mobile device, for example, such as the mobile phone, personal digital assistant ("PDA"), etc., displays image in the dimming mode to reduce power consumption. However, the light source driving unit consumes more than twice the energy compared to that consumed by the light emitting diode. Therefore, a light source driving apparatus capable of decreasing power consumption in a low-luminance driving mode is desired.

BRIEF SUMMARY OF THE INVENTION

The present invention provides a light source driving apparatus capable of decreasing power consumption in a low-luminance driving mode.

The present invention also provides a display device having such a light source driving apparatus.

The present invention also provides a method of driving a light source.

In an exemplary embodiment of a light source driving apparatus according to the present invention, the light source driving apparatus includes a controller, a first driver and a second driver. The controller outputs a first control signal to drive the light source in a normal luminance mode and a second control signal to drive the light source in a low-luminance mode. The first driver drives the light source, based on a first voltage in response to the first control signal in the low-luminance mode. The second driver drives the light source, based on a second voltage in response to the second control signal in the normal luminance mode.

In an exemplary embodiment of a display device according to the present invention, the display device includes a display unit, a light source unit and a light source driving unit for driving a light source. The display unit uses light to display an image. The light source unit provides the light to the display unit. The light source driving unit for driving the light source controls an operation of the light source unit. The light source driving unit for driving the light source includes a controller, a first driver and a second driver. The controller outputs a first control signal to drive the light source in a normal luminance mode and a second control signal to drive the light source in a low-luminance mode. The first driver drives the light source, based on a first voltage in response to the first control signal in the low-luminance mode. The second driver drives the light source, based on a second voltage in response to the second control signal in the normal luminance mode.

In an exemplary embodiment of a method of driving a light source according to the present invention, light-emitting diodes are driven with a first driver based on a first voltage when a first control signal is provided in a first driving mode. The light-emitting diodes are driven with a second driver based on a second voltage when a second control signal is provided in a second driving mode. The light-emitting diodes are driven when a third control signal is provided in a third driving mode. The first driver is deactivated in the second driving mode.

In another exemplary embodiment of a method of driving a light source according to the present invention, a preliminary control signal is received. A driving mode is determined based on the preliminary control signal. Light-emitting diodes are operated in a low-luminance based on a dimming voltage and a ground voltage when the driving mode is determined to be a low-luminance driving mode.

According to the present invention, the light source driving apparatus decreases power consumption and prevents unnecessary power consumption from increasing in a low-luminance driving mode.

BRIEF DESCRIPTION OF THE DRAWINGS

The above and other aspects, features and advantages of the present invention will become readily apparent by reference to the following detailed description when considered in conjunction with the accompanying drawings wherein.

DETAILED DESCRIPTION OF THE INVENTION

Figure 1:
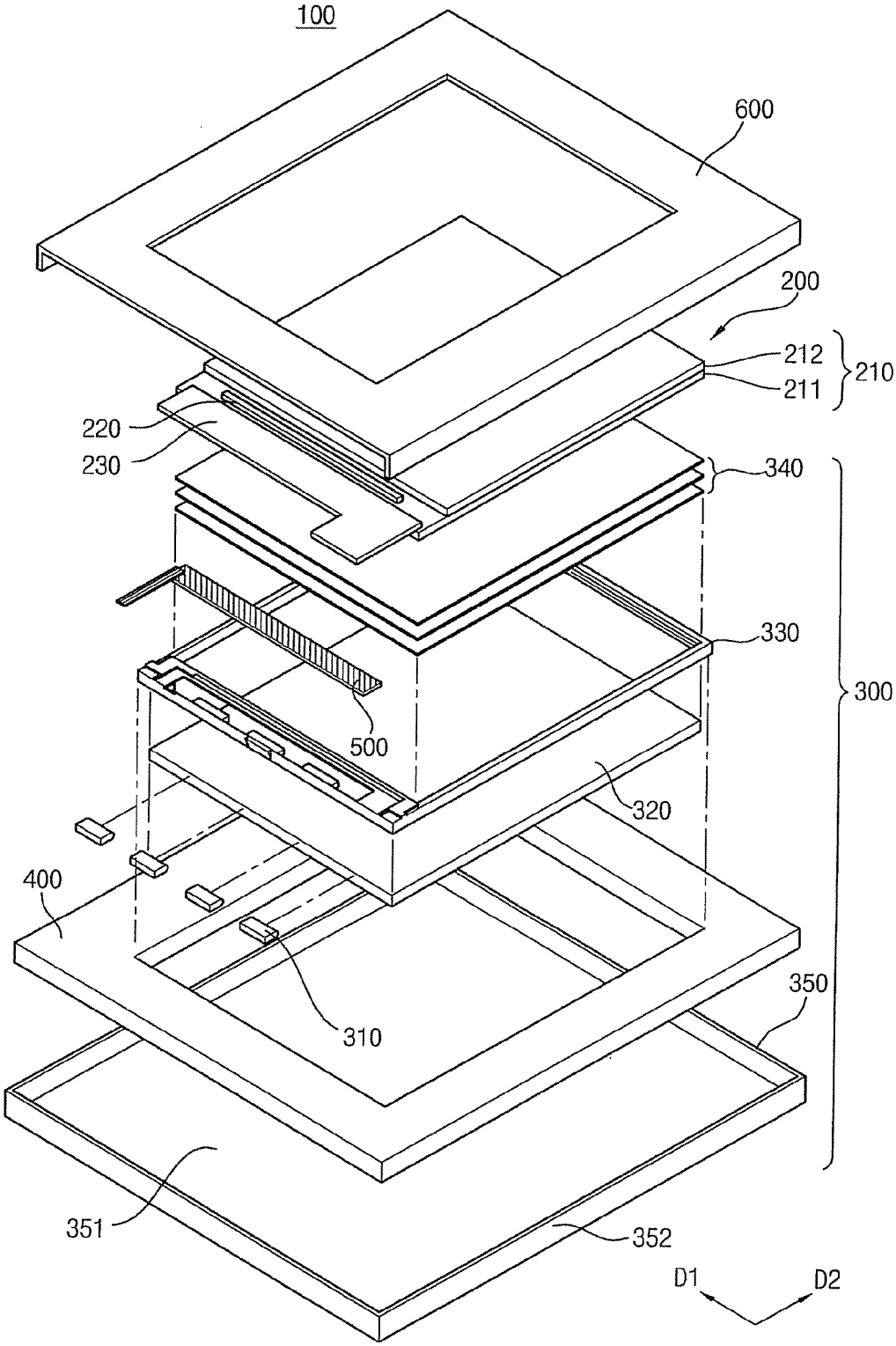
FIG. 1 is an exploded perspective view illustrating a display device in accordance with an exemplary embodiment of the present invention.

It should be understood that the exemplary embodiments of the present invention described below may be modified in many different ways without departing from the inventive principles disclosed herein, and the scope of the present invention is therefore not limited to these particular flowing exemplary embodiments. Rather, these exemplary embodiments are provided so that this disclosure will be thorough and complete, and will fully convey the concept of the invention to those skilled in the art. In the drawings, the size and relative sizes of layers and regions may be exaggerated for clarity.

It will be understood that when an element or layer is referred to as being "on," or "connected to" another element or layer, it can be directly on or connected to the other element or layer or intervening elements or layers may be present. In contrast, when an element is referred to as being "directly on" or "directly connected to" another element or layer, there are no intervening elements or layers present Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Spatially relative terms, such as "beneath," "below," "lower," "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the present invention are described herein with reference to cross-sectional illustrations that are schematic illustrations of idealized exemplary embodiments (and intermediate structures) of the present invention. As such, variations from the shapes of the illustrations as a result, for example, of manufacturing techniques and/or tolerances, are to be expected. Thus, exemplary embodiments of the present invention should not be construed as being limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the exemplary embodiments of the present invention will be described particularly with reference to the accompanied drawings.

FIG. 1 is an exploded perspective view illustrating a display device in accordance with an exemplary embodiment of the present invention.

Referring to FIG. 1, the display device 100 includes a display unit 200 displaying an image, a light source unit 300 providing a light in a predetermined luminance to the display unit 200 and a light source driving unit 400 controlling the light source unit 300.

The display unit 200 includes a display panel 210, a chip 220 for driving the display panel 210 and a first flexible circuit board ("FCB") 230.

The display panel 210 includes a first substrate 211, a second substrate 212 and a liquid crystal layer (not shown). The second substrate 212 faces the first substrate 211 and is combined with the first substrate 211. The liquid crystal layer (not shown) is interposed between the first and second substrates 211 and 212.

The first substrate 211 includes a plurality of pixels arranged in a matrix configuration. Each of the plurality of pixels includes a data line and a gate line (both not shown). The gate line extends in a first direction D1 and the data line extends in a second direction D2 substantially perpendicular to the first direction D1. The gate line intersects the data line and is electrically insulated from the data line. Also, each pixel of the plurality of pixels includes a thin film transistor (hereinafter, referred to as "TFT") electrically connected with the data and gate lines.

The chip 220 for driving the display panel 210 provides a data signal and a gate signal to the data and gate lines, respectively, to display the image. The chip 220 for driving the display panel 210 may be mounted on a side portion of the first substrate 211 through chip-on-glass ("COG") process.

In the present exemplary embodiment, a gate driver chip applying a gate signal to the gate line, and a data driver chip applying a data signal to the data line are integrally formed to the chip 220 for driving the display panel 210. Alternatively, the gate driver chip and the data driver chip may be separately formed.

The first flexible circuit board ("FCB") 230 is mounted on a side portion of the first substrate 211 on which the chip 220 for driving the display panel 210 is mounted. The first FCB 230 provides a control signal to the chip 220 for controlling the display panel 210. The first FCB 230 includes a timing controller for controlling the output-timing of the data and gate signals and a memory for storing the data signal. The first FCB 230 is electrically connected to the first substrate 211 through an anisotropic conductive film ("ACF").

The light source unit 300 includes a light source 310, a light-guiding plate 320, a mold frame 330 and optical sheets 340.

The light source 310 generates the light. For example, the light source 310 may be a plurality of light-emitting diodes.

Also, the light source 310 may include a first light-emitting diode, a second light-emitting diode and a third light-emitting each generating a differently colored light. The first light-emitting diode emits a first-colored first light, the second light-emitting diode emits a second-colored second light and the third light-emitting diode emits a third-colored third light.

For example, each of the first, second and third light-emitting diodes emit red, green and blue lights, respectively. The number of each of the first, second and third light-emitting diodes may be plural. Each of the first, second and third light-emitting diodes control the luminance of the red, green and blue light, respectively, to emit the light being adjusted to white chromaticity coordinates.

The light-guiding plate 320 includes a light incident surface and a light-emitting surface. The light incident surface may be one side surface or both side surfaces of the light-guiding plate 320. The light-emitting surface may be an upper surface or a bottom surface of the light-guiding plate 320. The light source 310 is disposed adjacent to the light incident surface. The light, which enters the light-guiding plate 320 through the light incident surface, is emitted through the light-emitting surface.

The mold frame 330 receives the light source 310 and the light-guiding plate 320. Therefore, the mold frame 330 may provide a special receiving space in order for the light source 310 to be disposed at a side portion or both side portions of the light-guiding plate 320 (e.g., side edge(s) between the upper and bottom surfaces of the light-guiding plate 320). The mold frame 330 receives the optical sheets 340 and supports the optical sheets 340 over the light-guiding plate 320. Also, the mold frame 330 may include a second flexible circuit board ("FCB") 500 having a circuit pattern for providing a driving-power to the light source 310 formed thereon.

The optical sheets 340 are disposed over the light-guiding plate 320. The optical sheets 340 diffuse/adjust the light provided from the light-guiding plate 320 and improve a luminance characteristic of the light emitted therefrom. For example, the optical sheets 340 may include a prism sheet and a diffusion sheet. The diffusion sheet diffuses the light provided from the light guide plate 320 and improves the luminance uniformity of the light.

Also, the light source unit 300 may further include a receiving container 350 which receives the light source 310, the light-guiding plate 320, the mold frame 330 and the optical sheets 340.

The receiving container 350 includes a bottom plate 351 and side walls 352. The side walls 352 extend perpendicularly from peripheral portions of the bottom plate 351. The bottom plate 351 and the side walls 352 together provide a receiving space into which the light source 310, the light-guiding plate 320, the mold frame 330 and the optical sheets 340 are received.

The light source driving unit 400 outputs a power voltage and control signals for driving the light source 310. The light source driving unit 400 includes a printed circuit board including a plurality of circuit-pattern layers. The circuit-pattern may become a transferring path of the power voltage and control signals. A chip for driving the light source (not shown) and peripheral circuit elements (not shown) are mounted on the uppermost of the plurality of layers.

The light source driving unit 400 and the light source 310 are connected at a point of contact through the second FCB 500. The light source driving unit 400 provides the power voltage and control signals to the light source 310 through the second FCB 500.

The light source driving unit 400 includes a controller (not shown). The controller outputs a first control signal, a second control signal and a third control signal for driving the light source 310 in a first driving mode, a second driving mode and a third driving mode, respectively.

The first driving mode may be defined as a normal-luminance driving mode. In the first driving mode, the light source driving unit 400 provides a high voltage to the light source 310 and the display unit 200 displays the image in a normal-luminance. The second driving mode may be defined as a dimming driving mode. In the dimming driving mode, the light source driving unit 400 provides a low voltage, which is relatively lower than the high voltage provided in the first driving mode, to the light source 310 and the display unit 200 displays the image in a low-luminance. After the light source 310 is driven in the first driving mode, the light source 310 is driven in the second driving mode in response to an external signal or a sensing signal being sensed from an external luminance. The third driving mode may be defined as a standby mode in which the light source 310 is off.

Also, the light source driving unit 400 includes a first driver and a second driver. The first driver receives the first and third control signals and drives the light source 310 in the first and third driving modes, respectively. The second driver receives the second control signal and drives the light source 310 in the second driving mode.

The light source driving unit 400 will be explained in more detail below in the description of FIGS. 2 to 4.

Still referring to FIG. 1, the display device 100 may further include a top chassis 600. The top chassis 600 is combined with the receiving container 350. Also, the top chassis 600 covers the edge portion of the display panel 210 so that an effective display part of the display panel 210 is open. The top chassis 600 protects the display panel 210 from external impact. Also, the top chassis 600 prevents separation of the display panel 210 from the upper part of the light source unit 300.

Figure 2:
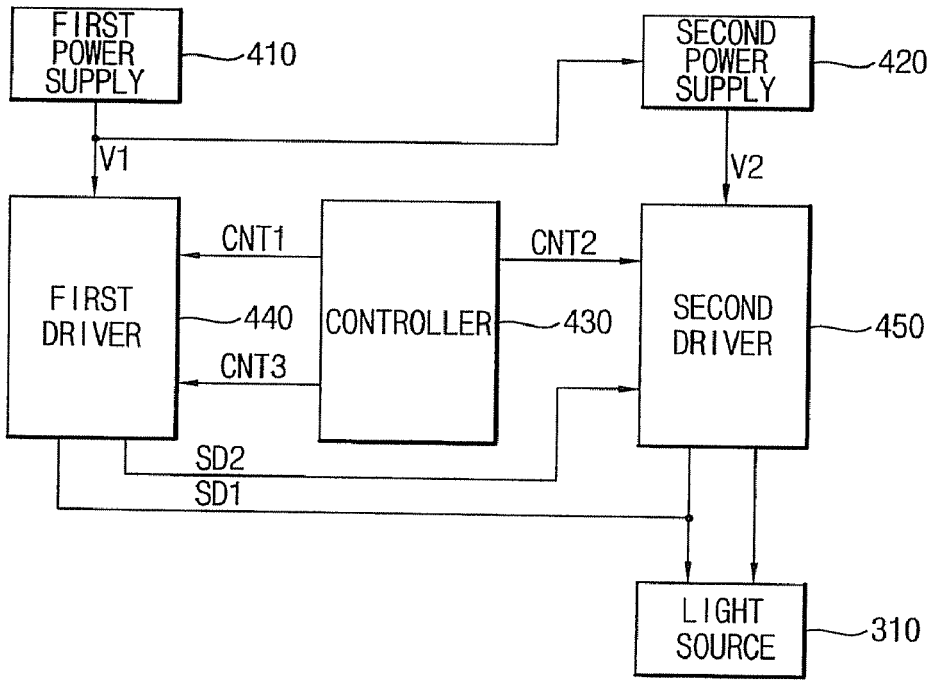
FIG. 2 is a block diagram illustrating a light source driving apparatus in accordance with an exemplary embodiment of the present invention.

FIG. 2 is a block diagram illustrating a light source driving apparatus in accordance with an exemplary embodiment of the present invention. Hereinafter, the apparatus for driving the light source means the light source driving unit 400 in FIG. 1. Thus, the same reference numerals will be used to refer to the same or like parts as those described in the above-explained exemplary embodiment in FIG. 1.

Referring to FIGS. 1 and 2, the apparatus for driving the light source 400 includes a first power supply 410, a second power supply 420, a controller 430, a first driver 440 and a second driver 450.

The first power supply 410 generates a first voltage (or reference voltage) V1 and provides the first voltage V1 to the first driver 440. Then, when the first power supply 410 is applied to a mobile product like a mobile phone, for example, the first power supply 410 may be a battery that has a limited electric power and is chargeable.

The second power supply 420 receives the first voltage V1 from the first power supply 410, generates a second voltage (or dimming voltage) V2 based on the first voltage V1 and provides the second voltage V2 to the second driver 420. The level of the second voltage V2 may be lower than the level of the first voltage V1.

The controller 430 provides a first control signal CNT1, a second control signal CNT2 and a third control signal CNT3. The controller 430 provides the first control signal CNT1 for driving the light source 310 in the first driving mode, the second control signal CNT2 for driving the light source 310 in the second driving mode and the third control signal CNT3 for driving the light source 310 in the third driving mode.

The controller 430 may include a memory (not shown) storing a program configured to drive the light source 310 in the first, second and the third driving modes. The controller 430 may be driven by the program stored in the memory and provide the first, second and third control signals CNT1, CNT2 and CNT3.

For example, after the controller 430 drives the light source 310 in the first driving mode during a predetermined time, the controller 430 may control the light source 310 to drive in the second and third driving modes.

Also, the controller 430 may provide the first, second and third control signals CNT1, CNT2 and CNT3 by a switching operation activated by users. Furthermore, the controller 430 may provide the first, second and third control signals CNT1, CNT2 and CNT3 according to the luminance of external light. Thus, a light sensor formed at the display panel 210 may sense the luminance of an external light.

When the first, second and third control signals CNT1, CNT2 and CNT3 is outputted by the switching operation by the users, a preliminary control signal CNT_0 (not shown) may be provided to the controller 430. Also, when the first, second and third control signals CNT1, CNT2 and CNT3 are outputted according to sensing-result of the light sensor, the preliminary control signal CNT_0 may be provided from a timing-controller being formed at the first FCB 230.

When the preliminary control signal CNT_0 is provided to the controller 430, the controller 430 determines a driving mode through the preliminary control signal. Also, the controller 430 provides the first, second and third control signals CNT1, CNT2 and CNT3 corresponding to the determined driving mode. Alternatively, the controller 430 may provide the first, second and third control signals CNT1, CNT2 and CNT3 by various other methods.

Here, the first control signal CNT1 may include a light source enable-signal to drive the first driver 440. The first control signal CNT1 controls the first driver 440 in response to the first voltage V1 so that the light source 310 is driven in the first driving mode.

The second control signal CNT2 may include a dimming signal to drive the second driver 450. The second control signal CNT2 controls the second driver in response to the second voltage V2 and a ground voltage GND so that the light source 310 is driven in the second driving mode.

When the light source 310 is driven in the second driving mode or in the third driving mode, the third control signal CNT3 may include an off-signal to deactivate the first driver 440.

When the second control signal CNT2 is outputted, the first control signal CNT1 is disabled. Also, when the second control signal CNT2 is outputted, the third control signal CNT3 must be outputted.

If the first control signal CNT1 is outputted when the second control signal CNT2 is outputted, as the first driver 440 is driven, the light source 310 receives driving signals SD1 and SD2 based on the first voltage V1 and thus the light source 310, for example light-emitting diodes, outputs a higher-luminance light in the second driving mode compared with in the first driving mode. Also, when the third control signal CNT3 is outputted in the third driving mode, the second control signal CNT2 may be disabled.

The first driver 440 outputs first and second driving signals SD1 and SD2 in response to the first control signal CNT1. The first and second driving signals SD1 and SD2 drive the light source 310 in the first driving mode.

For example, if the light source 310 includes six light-emitting diodes, the first driving signal SD1 may be a driving voltage commonly provided to anode terminals of the light-emitting diodes. Also, the second driving signal SD2 may be a plurality of driving voltages separately provided to cathode terminals of the light-emitting diodes.

Therefore, the light-emitting diodes emit the light by a potential difference between the anode terminal and the cathode terminal. Then, the driving voltage having the same potential-level is provided to the anode terminal and the driving voltage having the different potential-level is provided to the cathode terminal. Accordingly, the light-emitting diodes provide the light in the predetermined luminance to the display panel 210 in the first driving mode.

The second driver 450 provides the second voltage V2 and the ground voltage GND to the light source 310 in response to the second control signal CNT2 and drives the light source 310 in the second driving mode. The second driver 450 will be explained referring to FIG. 3.

Figure 3:
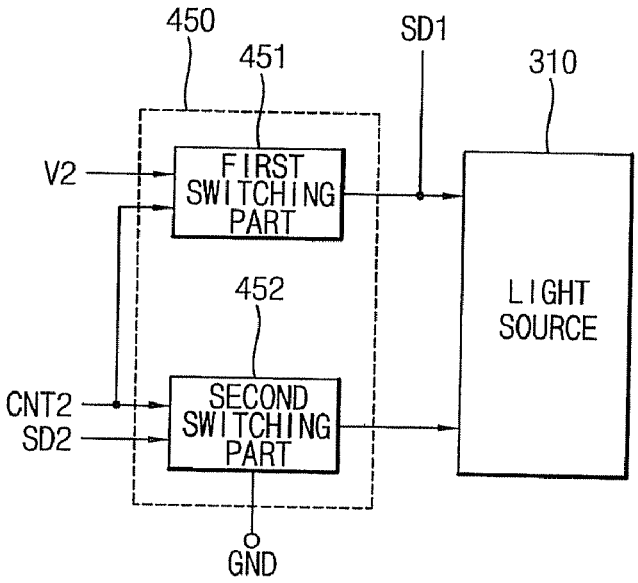
FIG. 3 is a block diagram illustrating a second driver in FIG. 2 in accordance with an exemplary embodiment of the present invention.

FIG. 3 is a block diagram illustrating the second driver 450 in FIG. 2.

Referring to FIGS. 2 and 3, the second driver 450 includes first and second switching parts 451 and 452.

The first switching part 451 is activated by the second control signal CNT2 outputted from the controller 430, and provides a second voltage V2 outputted from the second power supply 420 to the light source 310. For example, when the light source 310 includes light-emitting diodes, the first switching part 451 provides a second voltage V2 to the anode terminal of the light-emitting diodes.

The second switching part 452 is activated by the second control signal CNT2, and provides a ground voltage GND to the light source 310. For example, when the light source 310 includes light-emitting diodes, the second switching part 452 provides a ground voltage GND to the cathode terminal of the light-emitting diodes.

Hereinafter, an operation of the first and second drivers 440 and 450 in accordance with the present exemplary embodiment of the present invention will be explained.

First, the controller 430 provides the second control signal CNT2 to the first and second switching parts 451 and 452. The first and second switching parts 451 and 452 are activated in response to the second control signal CNT2.

Then, when the first switching part 451 is activated, the second voltage V2 is provided to the anode terminal of the light-emitting diode. Simultaneously, when the second switching part 452 is activated, the ground voltage GND is provided to the cathode terminal of the light-emitting diode. Therefore, the light source 310 is activated by a potential difference between the second voltage V2 and the ground voltage GND, and provides the light in a low-luminance corresponding to a second driving mode.

Also, when the controller 430 does not output the second control signal CNT2, the first and second switching parts 451 and 452 are disabled. When the first switching part 451 is disabled, a first driving signal SD1 being inputted to an output terminal of the first switching part 451 is provided to the anode terminal of the light-emitting diode. When the second switching part 452 is disabled, a second driving signal SD2 being inputted to an output pad of the second switching part 452 is provided to the cathode terminal of the light-emitting diode.

Here, when the light source 310 includes a plurality of the light-emitting diodes, the first driving signal SD1 is commonly provided to the anode terminal of the light-emitting diodes, and the second driving signal SD2 having different potentials from that of the first driving signal SD1 is provided to the cathode terminal of the light-emitting diodes. Therefore, the light source 310 is activated by the potential difference between the first and second driving signals SD1 and SD2, and emits the light of the luminance corresponding to the first driving mode, for example, the normal-luminance driving mode.

Figure 4:
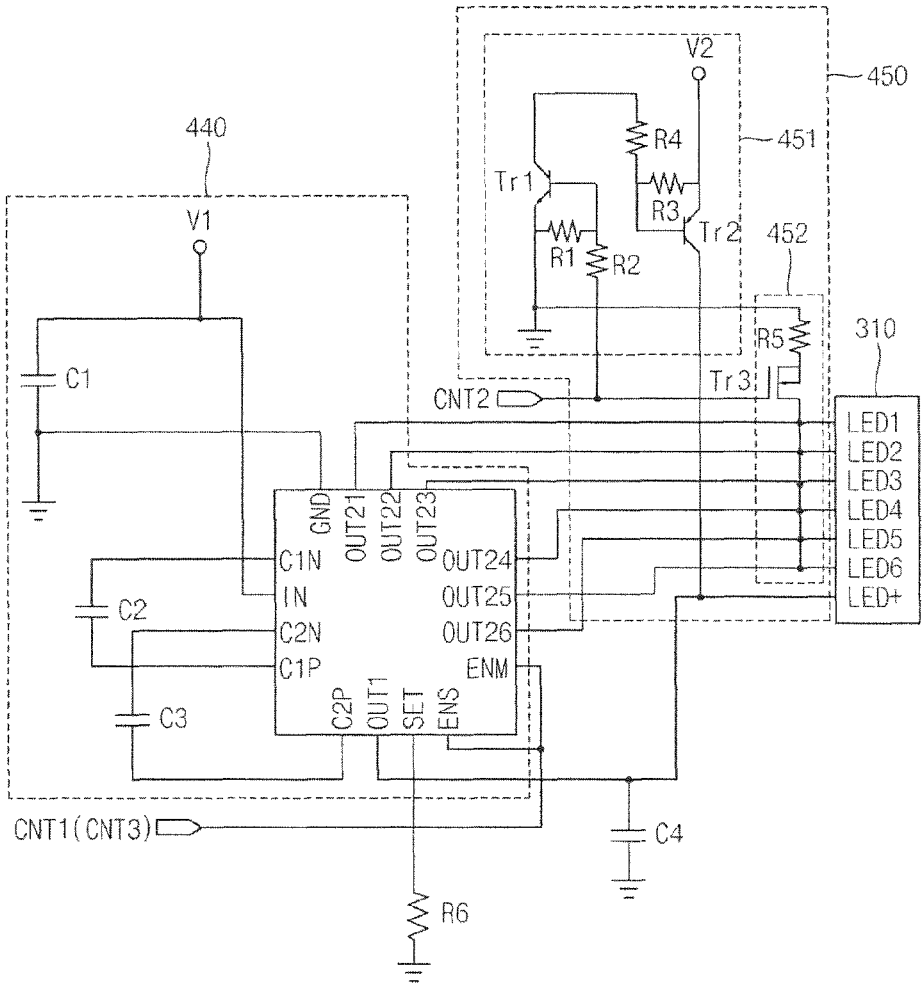
FIG. 4 is a circuit schematic diagram illustrating a light source driving apparatus in accordance with an exemplary embodiment of the present invention.

FIG. 4 is a circuit schematic diagram illustrating a light source driving apparatus in accordance with an exemplary embodiment of the present invention. In FIG. 4, the first and second drivers 440 and 450 in the light source driving apparatus in FIG. 2 are illustrated.

Referring to FIGS. 2 to 4, the light source driving apparatus includes the first driver 440 and the second driver 450.

The first driver 440 may be embodied in one chip. The first driver 440 drives the light source 310 in the first driving mode. For example, the first driver 440 may be a MAX1575™ (manufactured by MAXIM Integrated Products, Inc. U.S.A.)

The first driver 440 includes an input terminal IN, a first output terminal OUT1 and a plurality of second output terminals OUT2 to OUT26. A first voltage V1 is inputted to the input terminal IN. The first output terminal OUT1 outputs a first driving signal SD1 that is to be commonly provided to an anode terminal of light-emitting diodes LED1, LED2, LED3, LED4, LED5 and LED6. The second output terminals OUT21 to OUT26 outputs second driving signals SD2 to cathode terminals of light-emitting diodes LED1, LED2, LED3, LED4, LED5 and LED6, respectively.

Also, the first driver 440 may further include a ground terminal GND, first and second control terminals ENS and ENM, voltage raising terminals C1P, C2P, C1N and C2N and a control terminal SET. The ground voltage is applied to the first driver 440 through the ground terminal GND. A first control signal CNT1 is applied to the first driver 440 through the first and second control terminals ENS and ENM, so that the first driver 440 controls the light-emitting diodes LED1, LED2, LDE3, LDE4, LDE5 and LED6. The first driver 440 raises the potential level of the first voltage V1 through the voltage raising terminals C1P, C2P, 1N and C2N. The first driver 440 controls the output level of the first driving signal SD1 through the control terminal CNT1.

The second driver 450 may include a first switching part 451 and a second switching part 452.

The first switching part 451 includes a first switching element Tr1 and a second switching element Tr2. The first switching element Tr1 is turned on in response to a second control signal CNT2 outputted from the controller 430 (FIG. 2). The second switching element Tr2 is turned on according to the operational condition of the first switching element Tr1 and controls an output of a second voltage V2.

The second control signal CNT2 is provided to a base terminal of the first switching element Tr1. When the second control signal CNT2 is provided, the first switching element Tr1 is turned on. Therefore, the ground voltage GND is provided to a base terminal of the second switching element Tr2.

The second switching element Tr2 is turned on according to the ground voltage GND provided to a base terminal of the second switching element Tr2. The second voltage V2 is provided to the anode terminal LED+ of the light-emitting diodes LED1, LED2, LED3, LED4, LED5 and LED6. Then, a collector terminal of the second switching element Tr2 is electrically connected to the first output terminal OUT1 of the first driver 440. When the second switching part 452 is disabled, the first driving signal SD1 is provided from the first driver 440 to the anode terminal LED+ of the light-emitting diodes LED1, LED2, LED3, LED4, LED5 and LED6.

The second driver 450 includes a third switching element Tr3 receiving the second control signal CNT2.

For example, the third switching element Tr3 may include a NMOS transistor. A gate terminal of the third switching element Tr3 receives the second control signal CNT2. A drain terminal of the third switching element Tr3 is electrically connected to the cathode terminal of the light-emitting diodes LED1, LED2, LED3, LED4, LED5 and LED6. A source terminal of the third switching element Tr3 receives the ground voltage GND.

According to the second control signal CNT2 provided to the third switching element Tr3, the third switching element Tr3 is turned on, and provides the ground voltage GND to the cathode terminal of the light-emitting diodes LED1, LED2, LED3, LED4, LED5 and LED6. For the simplicity of the drawings in FIG. 4, the third switching element Tr3 is drawn to be commonly connected to the cathode terminals of the light-emitting diodes LED1, LED2, LED3, LED4, LED5 and LED6 such that the cathode terminals of the light-emitting diodes LED1, LED2, LED3, LED4, LED5 and LED6 are electrically connected to each other. However, in an exemplary embodiment, six (6) third switching elements Tr3 are respectively formed at each of the light-emitting diodes LED1, LED2, LED3, LED4, LED5 and LED6. Alternatively, the third switching element Tr3 may be commonly connected to each of the cathode terminals of the light-emitting diodes LED1, LED2, LED3, LED4, LED5 and LED6 such that the cathode terminals of the light-emitting diodes LED1, LED2, LED3, LED4, LED5 and LED6 are electrically insulated from each other.

Therefore, when the first switching part Tr1 is activated, the second voltage V2 is provided to the anode terminals LED+ of the light-emitting diodes LED1, LED2, LED3, LED4, LED5 and LED6. Simultaneously, the second switching part Tr2 is activated and the ground voltage GND is provided to the cathode terminals of the light-emitting diodes LED1, LED2, LED3, LED4, LED5 and LED6.

Also, when the controller 430 (FIG. 2) outputs the second control signal CNT2, the first control signal CNT1 is controlled so as to not to be outputted and the first driver 440 is disabled. Therefore, when the light source 310 is driven in the second driving mode, the mode of providing the low-luminance light, the second driver 450 is only driven based on the second voltage V2 provided by the second power supply 420.

The first and second drivers 440 and 450 are separately formed in FIGS. 2 and 4. Alternatively, the first and second drivers 440 and 450 may be integrally formed in one chip.

Figure 5:
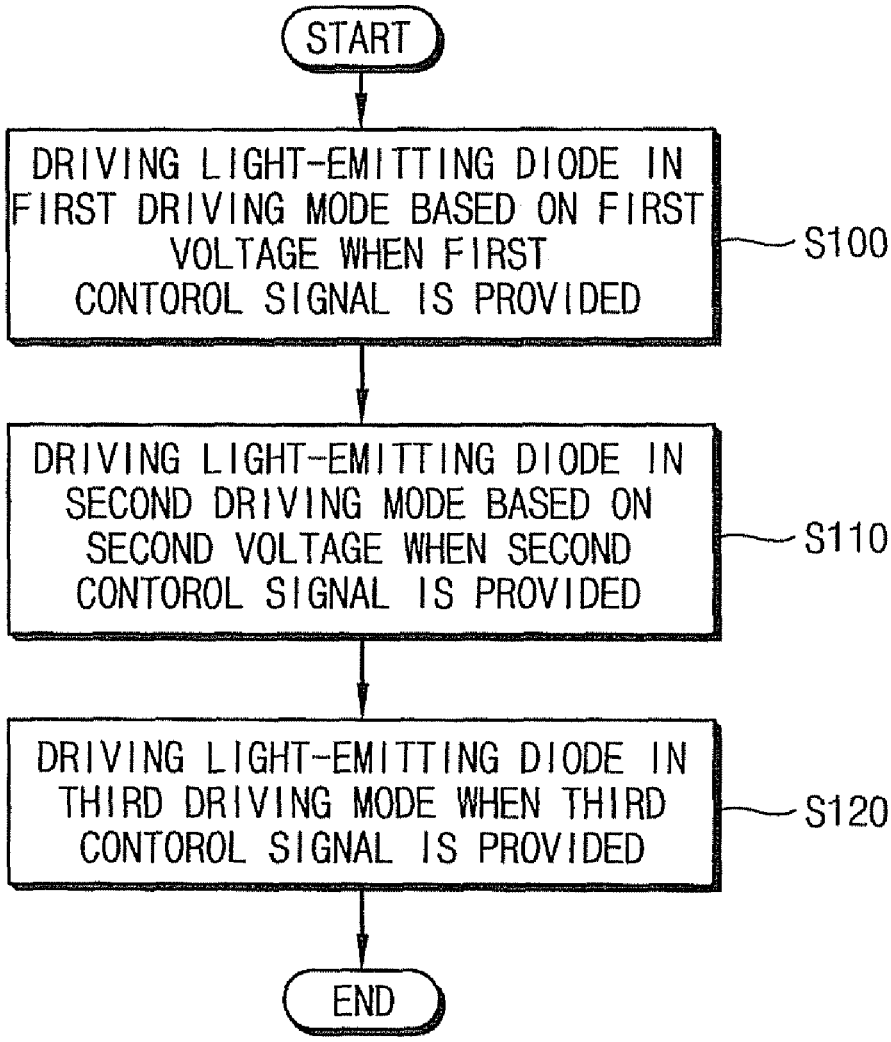
FIG. 5 is a flow chart illustrating a method of driving the light source in accordance with an exemplary embodiment of the present invention.

FIG. 5 is a flow chart illustrating a method of driving the light source in accordance with an exemplary embodiment of the present invention.

Referring to FIGS. 2 and 5, according to the method of driving the light source, when the first control signal CNT1 is provided, a light-emitting diode is driven in a first driving mode, based on the first voltage V1 (step S100). When the second control signal CNT2 is provided, a light-emitting diode is driven in a second driving mode, based on a second voltage (step S110). Then, when the third control signal CNT3 is provided, a light-emitting diode is driven in a third driving mode (step S120).

In step S100, the first driver 440 is activated in response to the first control signal CNT1 outputted from the controller 430. The first driver 440 generates driving signals to drive the light source 310, based on the first voltage V1 provided from a first power supply 410.

Then, as mentioned above, when the light-emission diodes are used as the light source, the driving signals include the first driving signal SD1 and second driving signals SD2. The first driving signal SD1 is commonly provided to anode terminals of the light source emission diodes and the second driving signal SD2 are respectively provided to a cathode terminal thereof. Also, the second driving signals SD2 are correspondingly generated to the respective number of the light source emission diodes.

Then, the first and second driving signals SD1 and SD2 are respectively provided to the light-emitting diodes, so that the light-emitting diodes are driven in the first driving mode during a designated time.

In step S110, after the light-emitting diodes are driven in the first driving mode during a predetermined time, a second driver 450 is activated, in response to the second control signal CNT2 outputted from the controller 430. Simultaneously, the controller 430 outputs a third control signal CNT3 and deactivates the first driver 440. Then, the second voltage V2 and a ground voltage GND, which are provided to the second driver 450, are respectively provided to the anode and cathode terminals of the light-emitting diodes. The light-emitting diodes are driven in the second driving mode by a potential difference between the second and ground voltage V2 and GND.

For example, the first voltage V1 may be about 3.6 V, the second voltage V2 may be about 2.8 V. Therefore, the light-emitting diodes emit a low-luminance light in the second driving mode in response to the second voltage V2 compared to the first driving mode in response to the first voltage V1.

In step S120, after the light-emitting diodes are driven in the second driving mode during a predetermined time, the controller 430 outputs only the third control signal CNT3 and allows the first and second drivers 440 and 450 to be disabled. Therefore, the light-emitting diodes are turned off and driven in a standby mode.

Figure 6:
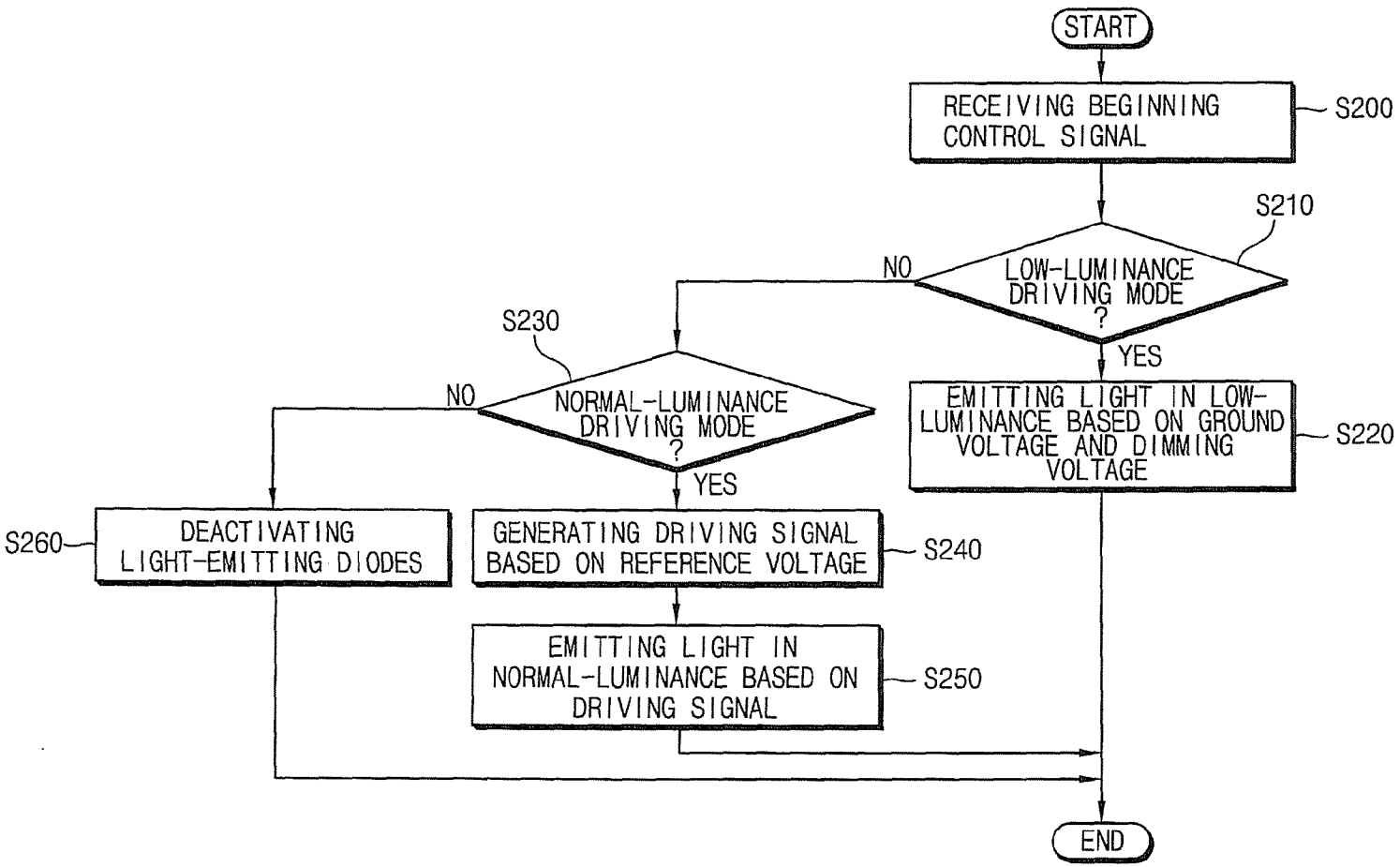
FIG. 6 is a flow chart illustrating a method of driving a light source in accordance with another exemplary embodiment of the present invention.

FIG. 6 is a flow chart illustrating a method of driving a light source in accordance with another exemplary embodiment of the present invention.

Referring to FIGS. 2 and 6, according to the method of driving the light source 310 in accordance with another exemplary embodiment of the present invention, a preliminary control signal is received (step S200). Then a driving mode is determined, based on the preliminary control signal (step S210). When the driving mode is determined to be a low-luminance driving mode, light-emitting diodes emit a low-luminance light, based on a dimming voltage and a ground voltage.

Also, when the driving mode is determined not to be the low-luminance driving mode, the driving mode is checked whether to be a normal-luminance driving mode (step S230). When the driving mode is determined to be the normal-luminance driving mode, driving signals are generated, based on a reference voltage (step S240). Then, a normal-luminance light is generated, based on the driving signals (step S250).

When the driving mode is determined not to be the low-luminance driving mode, the light-emitting diodes are deactivated (step S260).

Particularly, in step S200, according to a switching operation of users or a sensing result of a light sensor being formed at the display panel 210 in FIG. 1, the preliminary control signal is outputted. Then a controller 430 receives the preliminary control signal CNT_0.

In step S210, the controller 430 determines whether the driving mode, which the preliminary control signal CNT_0 indicates, is the low-luminance driving mode (or the second driving mode).

In step S220, when the driving mode is determined to be the second driving mode, the controller 430 outputs a second control signal CNT2 and activates the second driver 450.

Also, the controller 430 outputs a third control signal CNT3 with the second control signal CNT2 and deactivates the first driver 440. Therefore, the light source 310 receives a second voltage V2 and a ground voltage from the second driver 450 and is driven in the low-luminance driving mode, for example, the second driving mode.

In step S230, when the driving mode is determined not to be the second driving mode in step S210, the controller 430 determines whether the driving mode that the preliminary control signal CNT_0 indicates is the normal-luminance driving mode, for example, a first driving mode.

In step S240, when the driving mode is determined to be the first driving mode in step S230, the controller 430 outputs a first control signal CNT1 and activates a first driver 440. Therefore, the first driver 440 generates a first driving signal SD1 and a plurality of second driving signals SD2 for driving the light source 310, based on a first voltage V1.

In step S250, the light source 310 is driven in the first driving mode in response to the first and second driving signals SD1 and SD2.

In step S260, when the driving mode that the preliminary control signal CNT_0 indicates is determined not to be the first driving mode in step S230, the controller 430 outputs the third control signal CNT3 and deactivates the first and second drivers 440 and 450. Then, the light source 310 is turned off and driven in a standby mode, for example, a third driving mode.

As mentioned above, when the driving mode is the first driving mode, the first driver 440 drives the light source 310 with a large power consumption. Also, when the driving mode is the second driving mode, the first driver 440 is disabled and the second driver 450 drives the light source 310 with a smaller power consumption compared to the first mode. Therefore, an apparatus for driving the light source is provided that prevents unnecessary power consumption.

According to the present invention, when the apparatus for driving the light source is driven in a dimming mode, for example the low-luminance driving mode, mobile products having the apparatus for driving the light source prevent unnecessary power consumption.

Also, when the display device according to the present invention consumes a same amount of power as a conventional backlight assembly, a current consumption of the apparatus for driving the light source is decreased. Therefore, the power consumption of the light source increases to enhance the luminance of the light source.

Furthermore, when the display device is employed by a mobile device using a battery, a time during which the mobile device is used is increased by reducing the overall power consumption.

The present invention has been described with reference to the exemplary embodiments. It is evident, however, that many alternative modifications and variations will be apparent to those having skill in the art in light of the foregoing description. Accordingly, the present invention embraces all such alternative modifications and variations as falling within the spirit and scope of the appended claims.

What is claimed is:

1. A light source driving apparatus, comprising:

a controller which outputs a first control signal to drive a plurality of light sources in a normal-luminance mode and a second control signal to drive the light sources in a low-luminance mode;

a first driver which generates a first driving signal and a plurality of second driving signals based on a first voltage in response to the first control signal, provides the first driving signal to anode terminals of the light sources and respectively provides the second driving signals to cathode terminals of the light sources in the normal-luminance mode; and a second driver which includes a first switching element which is turned on in response to the second control signal, a second switching element which provides a second voltage lower than the first voltage to the anode terminals of the light sources when the first switching element is turned on a third switching element which provides a ground voltage to the cathode terminals of the light sources in response to the second control signal in the low-luminance mode, wherein the controller deactivates an operation of the first driver when an operation of the second driver is activated.

2. The apparatus of claim 1, wherein the first and second drivers are integrated in a single chip.

3. The apparatus of claim 1, wherein the light sources comprises a plurality of light-emitting diodes.

4. A display device comprising:

a display unit which displays an image;

a light source unit including a plurality of light sources and which provides the light to the display unit; and a light source driving unit which drives the light source unit by controlling an operation of the light source unit, wherein the light source driving unit comprises:

a controller which outputs a first control signal to drive the light sources in a normal-luminance mode and a second control signal to drive the light sources in a low-luminance mode;

a first driver which generates a first driving signal and a plurality of second driving signals based on a first voltage in response to the first control signal, provides the first driving signal to anode terminals of the light sources and respectively provides the second driving signals to cathode terminals of the light sources in the normal-luminance mode; and a second driver which includes a first switching element which is turned on in response to the second control signal, a second switching element which provides a second voltage lower than the first voltage to the anode terminals of the light sources when the first switching element is turned on and a third switching element which provides a ground voltage to the cathode terminals of the light sources in response to the second control signal in the low-luminance mode, wherein the controller deactivates an operation of the first driver when an operation of the second driver is activated.

5. The display device of claim 4, wherein the display unit comprises a display panel including:

a first substrate including an array of thin film transistors;

a second substrate disposed opposite the first substrate; and a liquid crystal layer interposed between the first and second substrates.

6. The display device of claim 4, wherein the light source unit comprises:

a first light-emitting diode which emits a first-colored light;

a second light-emitting diode which emits a second-colored light; and a third light-emitting diode which emits a third-colored light.

7. The display device of claim 4, further comprising a power supply which provides a DC voltage of a constant electric potential level.

8. The display device of claim 7, wherein the first voltage is the DC voltage outputted from the power supply, and the second voltage is a divided portion of the DC voltage.

9. A method of driving a light source, comprising:

driving a plurality of light-emitting diodes with a first driver, which provides a first driving signal to anode terminals of the light-emitting diodes and respectively provides a plurality of second driving signals to cathode terminals of the light-emitting diodes in response to a first control signal in a first driving mode;

driving the light-emitting diodes with a second driver which includes a first switching element which is turned on in response to the second control signal, a second switching element which provides a second voltage lower than the first voltage to the anode terminals of the light-emitting diodes when the first switching element is turned on and a third switching element which provides a ground voltage of to the cathode terminals of the light-emitting diodes in response to a second control signal in a second driving mode; and driving the light-emitting diodes when a third control signal is provided in a third driving mode, wherein the first driver is deactivated in the second driving mode.

10. The method of claim 9, wherein the first driving mode is a mode in which the light-emitting diodes emits the light of a normal-luminance, the second driving mode is a mode in which the light-emitting diodes emits the light having a lower-luminance than that in the first driving mode, and the third driving mode is a mode in which the light-emitting diodes are deactivated.

11. The method of claim 10, wherein driving the light-emitting diodes in the first driving mode comprises:

generating the first driving signal and the second driving signals, based on a first voltage; and driving the light-emitting diodes in response to the first driving signal and the second driving signals.

12. A method of driving a light source, comprising:

receiving a preliminary control signal;

determining a driving mode based on the preliminary control signal to output a first control signal and a second control signal corresponding to the determined driving mode;

activating an operation of a first driver in response to the first control signal and deactivating an operation of a second driver when the driving mode is determined to be a normal-luminance driving mode;

applying a first driving signal to anode terminals of a plurality of light-emitting diodes based on a first voltage and a plurality of second driving signals to cathode terminals of the light-emitting diodes according to the operation of the first driver;

deactivating the operation of the first driver and activating the operation of the second driver in response to the second control signal when the driving mode is determined to be a low-luminance driving mode; and applying a dimming voltage to the anode terminals of the light-emitting diodes and a ground voltage to the cathode terminals of the light-emitting diodes according to the operation of the second driver which includes a first switching element which is turned on in response to the second control signal, a second switching element which provides a dimming voltage lower than the first voltage to the anode terminals of the light sources when the first switching element is turned on and a third switching element which provides the ground voltage to the cathode terminals of the light-emitting diodes.

13. The method of claim 12, when the driving mode is determined to be a normal-luminance driving mode, the method further comprises:

generating the first driving signal and the second driving signals based on a reference voltage; and driving the light-emitting diode in response to the first driving signal and the second driving signals.

14. The method of claim 12, further comprising deactivating the light-emitting diodes when the driving mode is a standby mode.

* * * * *